US008119319B2

(12) United States Patent
Kawamura et al.

(10) Patent No.: US 8,119,319 B2
(45) Date of Patent: Feb. 21, 2012

(54) METHOD FOR PRODUCING POSITIVE CHARGING TONER

(75) Inventors: Masateru Kawamura, Toyoake (JP); Yasutomo Imai, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 508 days.

(21) Appl. No.: 12/415,228

(22) Filed: Mar. 31, 2009

(65) Prior Publication Data

US 2009/0246681 A1 Oct. 1, 2009

(30) Foreign Application Priority Data

Mar. 31, 2008 (JP) ..... 2008-092016

(51) Int. Cl.
*G03G 9/08* (2006.01)

(52) U.S. Cl. ..... 430/137.11; 430/137.14; 430/137.15; 430/137.16

(58) Field of Classification Search ..... 430/137.11, 430/137.14, 137.15, 137.16
See application file for complete search history.

(56) References Cited

U.S. PATENT DOCUMENTS

| | | | | |
|---|---|---|---|---|
| 4,840,863 | A | 6/1989 | Otsu et al. | |
| 2002/0051923 | A1 * | 5/2002 | Takayanagi et al. | 430/108.4 |
| 2007/0072103 | A1 | 3/2007 | Kawamura et al. | |

FOREIGN PATENT DOCUMENTS

| | | | |
|---|---|---|---|
| JP | 63-060458 | A | 3/1988 |
| JP | 03-175456 | A | 7/1991 |
| JP | 03-243954 | A | 10/1991 |
| JP | 08-220809 | A | 8/1996 |
| JP | 11-015192 | A | 1/1999 |
| JP | 2000-292976 | A | 10/2000 |
| JP | 2006091564 | A | 4/2006 |
| JP | 2006293057 | A | 10/2006 |
| JP | 2007-094041 | A | 4/2007 |

OTHER PUBLICATIONS

Notification of Reasons for Rejection for Japanese Patent No. 2008-092016, mailed Feb. 16, 2010, 5 pages.

* cited by examiner

*Primary Examiner* — Hoa Le
(74) *Attorney, Agent, or Firm* — Banner & Witcoff, Ltd.

(57) ABSTRACT

The present teaching provides a method for producing a positive charging toner that can exhibit stable charge characteristics. According to the present teaching, a positive charging toner is produced by preparing a base particle suspension having a conductivity not higher than 70 μS/cm and comprising base particles that are obtained by mixing and emulsifying an aqueous medium and a resin solution containing the polyester resin; producing toner base particles by mixing the base particle suspension with a charge control resin microparticle suspension containing charge control resin microparticles; causing the charge control resin microparticles to adhere to the surfaces of the base particles; and washing the toner base particles.

8 Claims, 1 Drawing Sheet

METHOD FOR PRODUCING POSITIVE CHARGING TONER

CROSS REFERENCE TO RELATED APPLICATION

The present application claims priority to Japanese Patent Application No. 2008-092016, filed Mar. 31, 2008, the contents of which are hereby incorporated into the present application by reference.

BACKGROUND OF THE INVENTION

1. Field of the Invention

The present invention relates to a method for producing a positive charging toner.

2. Description of the Related Art

In an electrophotographic or an electrostatic recording image forming apparatus, an image can be formed on a piece of paper by supplying a toner that is charged with a predetermined polarity and to a predetermined amount of charge, to an image forming section thereby distributing the toner over the paper so as to form the image, through the effect of an electric field, and then fixing the toner thus distributed over the paper.

The toner may be a magnetic two-component toner, in which the toner is charged through frictional charging by a magnetic carrier, or a non-magnetic mono-component toner, which is charged by friction with a contact section of the image forming apparatus, without using any magnetic carrier. Non-magnetic mono-component toners are advantageous for reducing the size of the image forming apparatus.

In order to stably obtain fine images in the above recording methods, it is important to stabilize the charge characteristics of the toner; namely, to make the charge distribution as uniform as possible while ensuring a sufficient charge amount. In order to stabilize the charge characteristics of the toner, control of the toner charge characteristics by means of a charge control agent is particularly important in the non-magnetic mono-component toners.

Conventional production methods of such toners include methods that involve synthesizing base particles by emulsifying a binder resin in a liquid. In such base particle synthesis methods, a suspension of static control microparticles comprising polar groups is supplied to a suspension of base particles comprising a negatively chargeable binder resin such as polyester, to stably fix the electrostatic control microparticles onto the surface of the base particles (as disclosed in Japanese Patent Application Laid-open No. 2007-94041). There have also been disclosed methods for washing toner base particles comprising a static control agent, to thereby keep conductivity at or below a predetermined value with a view to curbing variation in the charge amount of the toner base particles (Japanese Patent Application Laid-open No. 2000-292976).

SUMMARY OF THE INVENTION

In the method disclosed in the Japanese Patent Application Laid-open No. 2007-94041, the static control microparticles comprise polar groups. Therefore, although the static control microparticles become stably fixed to base particles comprising a negatively charged binder resin, and sufficient charge amount is ensured, there are instances in which image fogging occurs on the recording medium, which hinders in obtaining sharp images. Furthermore, even if the washing set forth in the Japanese Patent Application Laid-open No. 2000-292976 were carried out with the view to eliminating this variability, improved results were not necessarily guaranteed.

Specifically, in utilizing a method for synthesizing toner base particles such as the ones described above, no technology has been established so far for obtaining a positive charging toner that is endowed with stable charge characteristics.

It is thus an object of the present invention to provide a method for producing a positive charging toner that can exhibit stable charge characteristics.

With a view to solving the above problems, and after studying various factors that destabilize charge characteristics, the inventors found that there is a strong correlation between image defects and the conductivity of a base particle suspension before addition of charge control resin microparticles. The inventors perfected the present invention on the basis of that finding. The disclosure of the present description provides the means below.

According to the disclosure of the present description, a method for producing a positive charging toner comprising a polyester resin as a main component is provided. The method comprises steps of preparing a base particle suspension having a conductivity not higher than 70 μS/cm and comprising base particles that are obtained by mixing and emulsifying an aqueous medium and a resin solution containing the polyester resin; producing toner base particles by mixing the base particle suspension with a charge control resin microparticle suspension containing charge control resin microparticles; causing the charge control resin microparticles to adhere to the surfaces of the base particles; and washing the toner base particles.

In the method for producing the positive charging toner in the present description, the step of preparing the base particle suspension may comprise producing the base particles by aggregating resin microparticles obtained through the mixing and emulsifying. Further, the step of preparing the base particle suspension may comprise comprises producing the base particles by aggregating the resin microparticles, and thereafter lowering the conductivity by replacing at least a part of the aqueous medium. In the step of preparing the base particle suspension, the base particle suspension may contain no more than 300 ppm of a surfactant. Further, the step of preparing the base particle suspension may comprise using at least one compound selected from the group consisting of inorganic metal salts, alkalis and surfactants.

In the method for producing the positive charged toner in the present description, a charge control resin microparticle coefficient represented by formula (1) is not smaller than 0.014 in the step of producing toner base particles.

$$\text{charge control resin microparticle coefficient} = (\text{charge control resin microparticle amount(mg)}/\text{base particle amount(mg)} \times 100))/\text{conductivity of base particle suspension}(\mu\text{S/cm}) \quad (1)$$

In the formula (1), the charge control resin microparticle amount is the amount of charge control resin microparticles contained in the total amount of charge control resin microparticle suspension used, and the base particle amount is the amount of base particles contained in the total amount of base particle suspension used.

In the method for producing the positive charged toner in the present description, the charge control resin microparticles may comprise particles having a styrene-acrylic copolymer as a main component. The charge control resin microparticles may comprise a quaternary ammonium group.

In the method for producing the positive charged toner in the present description, the washing step may be a step of carrying out washing until a re-suspension that is obtained by re-suspending the washed toner base particles in an aqueous medium having a conductivity not higher than 1 μS/cm and contains 10 wt % solids of the washed toner base particles, has a conductivity not higher than 5 μS/cm.

DESCRIPTION OF THE PREFERRED EMBODIMENTS

Figure 1:
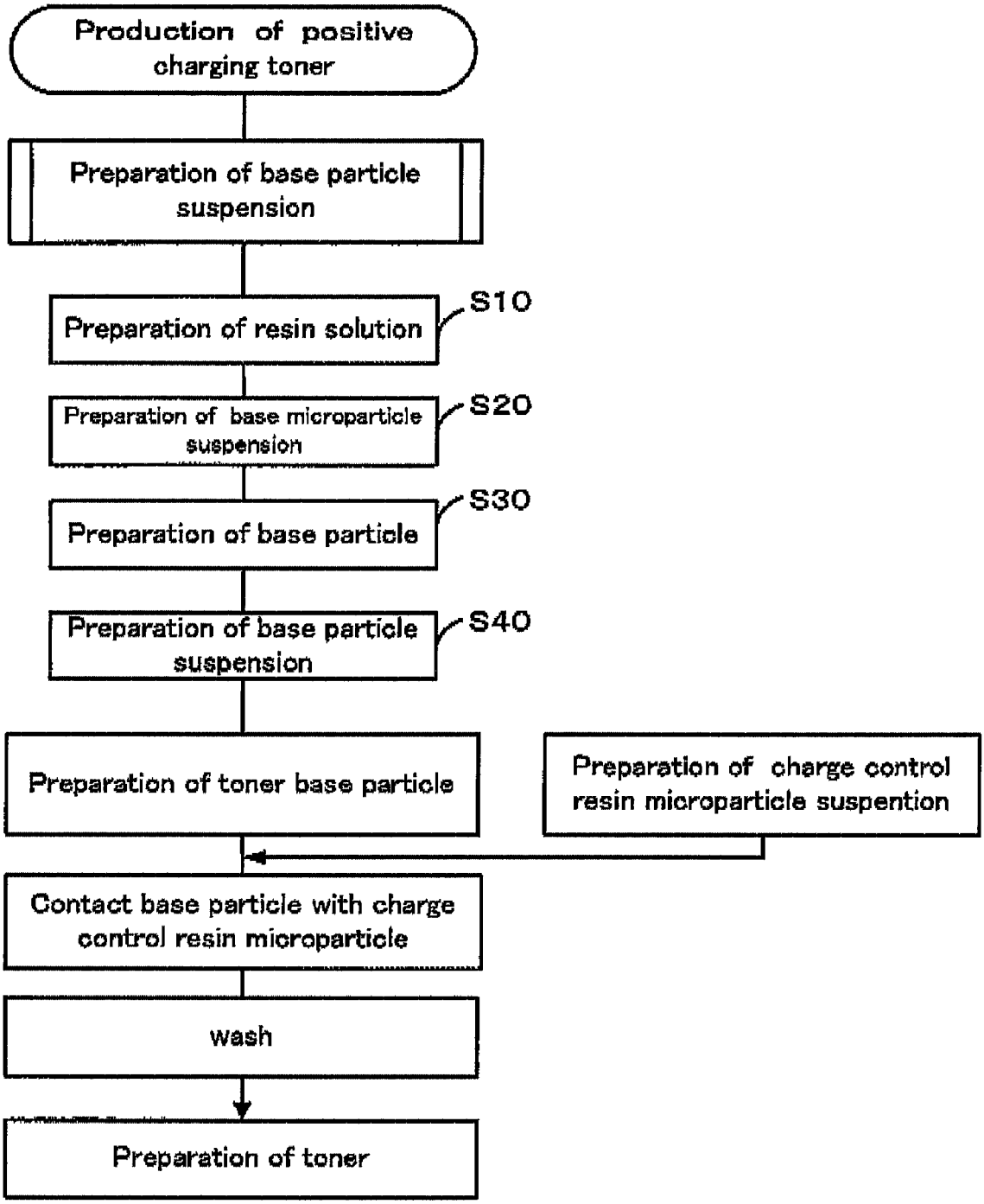
FIG. 1 is a diagram illustrating an example of a flow of a production process of the positive charging toner disclosed in the present description.

The disclosure of the present description relates to a method for producing a positive charging toner. A characterizing feature of the method for producing a positive charging toner disclosed in the present description involves prescribing the conductivity of a base particle suspension to be not higher than a predetermined value before mixing the base particle suspension with charge control resin microparticles. The disclosure of the present description is based on the hitherto wholly unnoticed findings, discovered for the first time by the inventors, to the effect that there is a strong correlation between image defects and the conductivity of a base particle suspension before addition of charge control resin microparticles, and that image defects can be avoided or reduced when the conductivity of the base particle suspension is not higher than a predetermined value before external addition.

The base particle suspension comprises base particles formed to toner size and various additives which are used for aggregating the base microparticles, both of which are dispersed or dissolved in an aqueous solvent. The inventors found that these additives adversely affect the charge characteristics of the toner by a hitherto wholly unknown mechanism. Specifically, the inventors found that when the positive charge control resin microparticles are supplied to the base particle suspension having electrolyte impurities, the electrolytes dissolved in the base particle suspension may precipitate and adhere to the surface of the base particles as a result of pH changes and/or the influence of the positive charge control microparticles. The inventors found also that such unintended adhered products impair the printing durability of the toner, and in extreme cases, may result in fogging from an early stage of toner use. Therefore, by removing the electrolyte impurities from the base particle suspension, namely by controlling the conductivity of the base particle suspension before supplying the positive charge control resin microparticles to the base particle suspension, it presently has been found that a positive charging toner with better and more stable quality that goes beyond the conventional expectations can be obtained.

Controlling the conductivity of the base particle suspension also allows achieving a state in which the charge control resin microparticles are readily fixed onto the surface of the base particles. It becomes therefore possible to fix the charge control resin microparticles more uniformly to the surface of the base particles, while reducing variation among the base particles as regards the amount of the charge control resin microparticles that are fixed thereon. In forming the images using such a positive charging toner in, for instance, electrophotography or electrostatic recording, initial image defects can therefore be avoided or reduced, and fine images can be stably formed.

The amount of the electrolyte impurities such as surfactants and dispersants can also be reduced, during the production of the base particles, by controlling the conductivity of the base particle suspension so as not to exceed a predetermined value. This as a result curbs the drop in the charge amount that is caused by the impurities and the like as the toner is fed in the image formation cycle over long periods of time. The initial charge amount can therefore be preserved over a long time, with reduced amount variation therein. This allows avoiding or minimizing image defects over long periods of time.

Also, a sufficient amount of charge control resin microparticles can be easily fixed to the base particles by setting the proportion of static control microparticles with respect to the conductivity of the base particle suspension to be at or above a predetermined value. This allows easy achievement of a positive charging toner having the desired charge characteristics.

An embodiment of the method for producing the positive charging toner disclosed in the present description will be explained in detail below with reference to the accompanying drawing. The various materials used in the production method of the positive charging toner disclosed in the present description will be explained first, and the production method itself next. FIG. 1 is a diagram illustrating an example of the flow of a production process of the positive charging toner disclosed in the present description.

In the present description, the term "resin solution" denotes a solution resulting from dissolving or dispersing a binder resin, a colorant, and optionally a release agent, in an organic solvent. The term "aqueous medium" denotes a medium, comprising mainly water, and used during mixing and emulsifying of the resin solution. The aqueous medium may contain a neutralizer. The term "base microparticles" denote solid microparticles in a suspension from which an organic solvent component is removed, after micro-emulsification of the resin solution in water. The term "base particles" denotes particles having a size level of a toner, obtained through aggregation/fusion of base microparticles. The term "toner base particles" denotes particles resulting from fixing charge control resin microparticles on the surface of the base particles. The term "toner" denotes dried toner base particles, with a hydrophobic inorganic dispersant optionally added and adhered to the surface to the toner base particles. The term "charge control resin microparticles" denote microparticles having a charge control resin as a main component.

(Toner Constituent Materials)

The positive charging toner obtained in accordance with the production method of the present invention comprises toner base particles. The toner base particles comprises base particles in which a polyester resin is the main component thereof with charge control resin microparticles on the surfaces thereof. Besides a binder resin, the base particles further comprise, for instance, a colorant, a release agent and a charge control agent. The toner base particles may have a hydrophobic inorganic dispersant on their surfaces.

(Binder Resin)

As the binder resin, although not limited thereto, a polyester resin that is conventionally used as the binder resin for toner may be used. The polyester resin is a commercially available polyester resin, having for instance an acid value of 0.5 to 40 mgKOH/g, preferably 1.0 to 20 mgKOH/g, a weight-average molecular weight (as measured by GPC based on standard polystyrene) of 9000 to 200000, preferably 20000 to 150000, and having a cross-linked fraction not higher than 10 wt % (THF insoluble fraction), preferably of 0.5 to 10 wt %. A lower acid value than the above ranges entails a smaller amount of reaction with a base such as sodium hydroxide that is added later, as a result of which emulsification may be destabilized and a stable slurry may fail to be obtained. When the acid value is higher than the above ranges, the toner is more likely to become negatively charged, which may give rise to problems such as reduced image density. When the weight-average molecular weight is lower than the above range, the mechanical strength of the toner may be insufficient, which may detract from the durability of the toner. To the contrary, a weight-average molecular weight higher than the above ranges results in an excessively high melt viscosity in the toner and in large emulsion droplets, whereby coarse particles are more likely to form. Although the cross-linked fraction may be zero, a certain non-zero cross-linked fraction is nonetheless preferable for toner strength and fixabilty (in particular, high-temperature offset). However, an excessive cross-linked fraction may give rise to large emulsion droplets and coarse particles.

Polyester resins are superior in that they are transparent, are sufficiently colorless so as not to compromise toner image hue, have good compatibility with the above charge control resin as well as adequate fluidity when heated or under pressure, and can be made into microparticles. Polyester resins are also excellent in terms of charge stability and image quality.

To determine the molecular weight of the resin, the resin component is dissolved in THF, the insoluble component is filtered off with DISMIC™ (diameter 0.2 μm, made of PTFE, by ADVANTEC), the THF solution fraction is collected and is measured in a GPC instrument, and the molecular weight distribution is calculated in terms of standard polystyrene.

(Colorant)

The colorant, which imparts a desired color to the toner, is incorporated into the binder resin through dispersion or permeation. Carbon black may be used as the colorant. Other examples include, for instance, organic pigments such as Quinophthalone Yellow, Hansa Yellow, Isoindolinone Yellow, Benzidine Yellow, Perynone Orange, Perynone Red, Perylene Maroon, Rhodamine 6G Lake, Quinacridone Red, Rose Bengal, Copper Phthalocyanine Blue, Copper Phthalocyanine Green, or a diketopyrrolopyrole pigment; inorganic pigments and metal powders such as Titanium White, Titanium Yellow, ultramarine, Cobalt Blue, red iron oxide, aluminum powder, and bronze; oil-soluble dyes and dispersion dyes such as azo dyes, quinophthalone dyes, anthraquinone dyes, xanthene dyes, triphenylmethane dyes, phthalocyanine dyes, indophenol dyes, and indoaniline dyes; and rosin dyes such as rosin, rosin-modified phenol, and rosin-modified maleic acid resin. Other examples include dyes and pigments treated with higher fatty acids or resins. The foregoing can be used alone or in combinations corresponding to a desired color. In the case of monochromatic color toner, for instance, the colorant can be prepared by mixing a pigment and a dye of the same color, such as a rhodamine pigment and dye, a quinophthalone pigment and dye, or a phthalocyanine pigment and dye. The colorant is mixed at a ratio of, for example, 2 to 20 parts by weight, preferably 4 to 10 parts by weight, relative to 100 parts by weight of the binder resin.

(Release Agent)

The release agent is added in order to improve the fixability of the toner to the recording medium. In the case of heat and pressure fixing, a wax is ordinarily incorporated into the toner in such a manner that the toner can detach easily from a heating medium. Examples of the release agent include, for instance, ester waxes and hydrocarbon waxes. Examples of ester waxes include, for instance, aliphatic ester compounds, such as stearates, palmitates, as well as polyfunctional ester compounds such as pentaerythritol tetramyristate, pentaerythritol tetrapalmitate and dipentaerythritol hexapalmitate. Examples of hydrocarbon waxes include, for instance, polyolefin waxes such as low-molecular weight polyethylene, low-molecular weight polypropylene and low-molecular weight polybutylene; natural vegetable waxes such as candelilla wax, carnauba wax, rice wax, Japan wax (sumac wax) and Jojoba wax; petroleum waxes such as paraffin, microcrystalline and petrolatum, as well as modified waxes thereof; and synthetic waxes such as Fischer-Tropsch waxes. These waxes can be used alone or in combinations. Preferably, the wax is one of the above waxes having a melting point of 50 to 100° C. A wax having a low melting point and a low melt viscosity melts before melting of the binder resin and becomes smeared on the toner surface, even for a low heating temperature in the fixing device. As a result, offset can be prevented. More specifically, the wax is an ester wax or a paraffin wax. The wax is blended in a proportion of, for instance, 1 to 30 parts by weight, preferably 3 to 15 parts by weight relative to 100 parts by weight of the binder resin.

(Charge Control Resin Microparticles)

The positive charging toner obtained in accordance with the production method of the present invention has charge control resin microparticles on the surface of base particles. The charge control resin microparticles are microparticles having a charge control resin as a main component. The charge control resin used has preferably polar groups. The polar groups in the charge control resin allow obtaining a well-dispersed charge control resin microparticle suspension, and also allow the charge control resin microparticles to be fixed homogeneously to the base particles. Preferred examples of polar groups include, for instance, quaternary ammonium groups, groups having a quaternary ammonium salt structure, amino groups, and groups having a phosphonium salt structure. In particular, groups having a salt structure are preferably used. Most preferably, the charge control resin used contains quaternary ammonium (salt) groups. Such groups having a salt structure allow obtaining a stable suspension, even when using no neutralizing agent or surfactants, or when using a limited amount thereof.

Examples of a charge control resin having quaternary ammonium groups include, for instance, a copolymer of a polymerizable component having a quaternary ammonium group, such as methacryloyl oxytrimethyl ammonium sulfate, with another copolymerizable component such as a vinyl-based monomer (cf. Japanese Patent Application Laid-open No. H8-220809) The copolymerizable component is not particularly limited, and any such component may be used so long as it has polymerizable unsaturated bonds. Specific examples thereof include, for instance, styrene, o,m,p-chlorostyrene, α-methyl styrene, vinyl toluene, (meth)acrylic acid, maleic acid, itaconic acid, methyl(meth)acrylate, ethyl (meth)acrylate, propyl(meth)acrylate, butyl(meth)acrylate, 2-ethylhexyl(meth)acrylate, amyl(meth)acrylate, cyclohexyl (meth)acrylate, lauryl(meth)acrylate, stearyl(meth)acrylate, behenyl(meth)acrylate, acrylamide, vinyl chloride, vinyl acetate and the like. Among these vinyl-based monomers there is preferably used at least one monomer selected from among styrene and alkyl(meth)acrylates. The akyl(meth) acrylate used has preferably a C1-C18 alkyl group.

As the charge control resin containing a quaternary ammonium (salt) group, a copolymer containing a quaternary ammonium (salt) group produced in accordance with the methods set forth in Japanese Patent Application Laid-open Nos. S63-60458, H3-175456, H3-243954, and H11-15192 may be utilized. Examples of commercially available charge control resins containing a quaternary ammonium (salt) group include, for instance, product name "FCA-207P" (synthetic resin comprising styrene 83%, butyl acrylate 15%, and N,N-diethyl-N-methyl-2-(methacryloyloxy) ethylammonium=p-toluenesulfonate 2%, having a weight-average molecular weight (Mw) of 12000 and a glass transition temperature (Tg) of 67° C., by Fujikura Kasei, or product name "FCA-201PS" provided by the same firm.

The weight-average molecular weight (Mw) of the charge control resin is preferably set in the range of 3000 to 100000. When the molecular weight (Mw) is less than 3000, toner particles are more likely to aggregate/fuse during heat fixing, and particle size becomes more difficult to control. Also, the strength of the charge control resin becomes weaker and printing durability tends to decrease. When the molecular weight exceeds 100000, particle size tends to increase during microparticulation, and it becomes harder to impart sufficient chargeability. Also, such a high molecular weight is more likely to adversely affect low-temperature fixabilty.

Preferably, the glass transition temperature (Tg) of the charge control resin is similar to or higher than that of the toner base particles. For instance, when the Tg of the toner base particles is 60° C., the Tg of the charge control resin is preferably set to 60 to 70° C.

The amount of polar groups in the charge control resin can be appropriately adjusted on the basis of the copolymerization conditions. When using for instance a styrene-acrylic copolymer charge control resin, the amount of polar groups can be adjusted by varying the amount of acryl monomers that are copolymerized.

The microparticles of the charge control resin being smaller is preferable, for more uniform microparticles can cover the surface of the base particles. Therefore, the average particle size of the charge control resin microparticles is preferably sufficiently small relative to the average particle size of the base particles and of a magnitude that does not substantially influence the average particle size of the toner base particles that are obtained through fixing of the charge control resin microparticles. The average particle size of the charge control resin microparticles varies depending on the average particle size of the toner to be obtained, but ranges preferably from about 50 to about 250 nm. The average particle size of the charge control resin microparticles can be determined by dynamic light scattering (laser Doppler), using a particle size analyzer Nanotrac™ UPA150 (manufactured by Nikkiso Co. LTD.). Specifically, the method set forth in the below examples may be utilized.

(External Additive)

Examples of the external additive include inorganic particles and synthetic resin particles. Examples of the inorganic particles that can be used include, for instance, silica, aluminum oxide, titanium oxide, silicon aluminum cooxide, silicon titanium cooxide, and hydrophobicized products thereof. Hydrophobization of a silica micropowder may involve, for instance, treating the silica micropowder with silicon oil or a silane coupling agent such as dichlorodimethylsilane, hexamethyldisilazane, tetramethyldisilazane or the like. Examples of synthetic resin particles include, for instance, methacrylate polymer particles, acrylate polymer particles, styrene-methacrylate copolymer particles, styrene-acrylate copolymer particles, and core-shell particles in which a shell of a methacrylate polymer is formed on a core of a styrene polymer. The addition amount of external additive is not particularly limited, and ranges ordinarily from 0.1 to 6 parts by weight relative to 100 parts by weight of the toner comprising the toner base particles and the charge control resin.

(Method for Producing the Positive Charging Toner)

An exemplary method for producing the positive charging toner of the present invention is explained below. The method for producing the positive charging toner of the present invention is a method for producing a positive charging toner comprising toner base particles in which positively chargeable charge control resin microparticles are disposed on the surfaces of base particles that have a polyester resin as their main component. The method can comprise a step of preparing a base particle suspension, a step of producing toner base particles, and a washing step. The production method of the present invention belongs to the so-called solution suspension methods and emulsification aggregation methods. Among these two, the production method of the present invention is suitable for emulsification aggregation, in which base particles of desired size are produced through aggregation of resin microparticles (base microparticles) obtained by emulsifying a binder resin using an emulsifier. With reference to FIG. 1, an explanation follows next on an example of a production process in which a toner is ultimately produced by preparing a base microparticle suspension from a polyester resin solution, aggregating then the base microparticles to yield a predetermined base particle suspension, and fixing charge control resin microparticles on the surfaces of the base particles, to thereby produce toner base particles, followed by washing.

(Preparation of a Base Particle Suspension)

The process of preparing a base particle suspension comprises a step S10 of preparing a resin solution containing a polyester resin; a base microparticle production step S20 of mixing and emulsifying the resin solution and an aqueous medium to produce thereby base microparticles; a base particle production step S30; and a base particle suspension preparation step S40 of washing the base particles and forming thereafter a suspension.

(Resin Solution Preparation) (Step S10)

As illustrated in FIG. 1, firstly the binder resin and the colorant, and optionally the release agent, are dissolved or dispersed in the organic solvent. Preferably, the binder resin is dissolved in the solvent. When using a pigment as the colorant, the pigment is micro-dispersed, since it does not dissolve. Although the release agent is preferably dissolved as well, it need not necessarily be dissolved, and may be micro-dispersed instead. In the preparation of the resin solution, the resin solution may be appropriately heated at a temperature not higher than the boiling point of the organic solvent. Such heating is particularly preferred when a release agent is dissolved or dispersed.

Preferably, the organic solvent dissolves a wax at a temperature below the boiling point, but it is also desirable that the organic solvent should exhibit some water solubility in order to promote emulsification of the binder resin. In the production method of the present invention, it is particularly preferred to reduce the use of dispersants such as surfactants or the like for stabilizing an emulsion of the resin solution. It becomes then necessary to neutralize the hydrophilic groups of the binder resin. When using as a result a wholly hydrophobic solvent, the neutralization reaction does not advance, and emulsion stabilization becomes harder to accomplish. The solvent therefore has some water solubility. Preferably, such an organic solvent can exhibit a compatibility of 1 to 100% towards water at 25° C. Specific examples of the organic solvent include, for instance esters such as ethyl acetate and butyl acetate; glycols such as ethylene glycol, diethylene glycol, ethylene glycol monomethyl ether and diethylene glycol monomethyl ether; ketones such as acetone, methyl ethyl ketone (MEK) and methyl isobutyl ketone; and ethers such as tetrahydrofuran (THF). These organic solvents can be used alone or in combination. Preferably, the organic solvent has a boiling point of 50 to 100° C., more preferably of 60 to 90° C. A specific example thereof is methyl ethyl ketone (boiling point: 79. 6° C. at normal pressure (1 atm)) or tetrahydrofuran (boiling point: 65° C. at normal pressure). The organic solvent is blended in a proportion of, for instance, 100 to 2000 parts by weight, preferably 200 to 1000 parts by weight relative to 100 parts by weight of binder resin.

In the preparation of the resin solution, a colorant dispersion is preferably prepared beforehand by micro-dispersing the colorant in a solvent. The method for dispersing the colorant may involve, for instance, mixing the colorant, a solvent and a dispersant, and pre-dispersing the mixture in a disper, a homogenizer or the like, followed by micro-dispersion in a bead mill, a high-pressure homogenizer or the like. In order to prevent colorant aggregation when preparing beforehand a colorant dispersion, the colorant dispersion is preferably diluted slowly first, and is then mixed with the resin and/or release agent to dissolve/disperse the foregoing during the preparation of the resin solution.

When using a dye or the like that dissolves in the solvent, the colorant need not particularly be dispersed. A dispersant for pigment dispersion is preferably used in order to micro-disperse the pigment. For instance, a surfactant or a high-molecular weight dispersant can be used as the dispersant. A binder resin may also function as a dispersant, and hence the binder resin may also be used as the dispersant.

(Preparation of a Base Microparticle Suspension) (Step S20)

As illustrated in FIG. 1, an emulsion is prepared next by mixing and emulsifying the resin solution and the aqueous medium, after which the organic solvent component is removed by evaporation, thereby to prepare a suspension in which the base microparticles are dispersed in the aqueous medium.

The aqueous medium may be water, or a liquid mixture of water and an organic solvent compatible with water. Examples of the organic solvent include, for instance, an alcohol. Examples of additives that may be comprised in the aqueous medium include, for instance, surfactants, dispersants and the like. In the production method of the present invention, the aqueous medium is preferably prepared as an aqueous alkaline solution. Examples of the aqueous alkaline solution include an aqueous organic base solution prepared by dissolving a basic organic compound such as an amine in water, and an aqueous inorganic base solution prepared by dissolving an alkaline metal such as sodium hydroxide or potassium hydroxide in water. The aqueous inorganic base solution is prepared as an aqueous sodium hydroxide solution or aqueous potassium hydroxide solution of, for example, 0.1 to 5N (normal), preferably 0.2 to 2N (normal). If a wax poorly dissolvable in the resin solution is blended therein on account of water inclusion, then an aqueous organic base solution is preferably employed, in terms of preventing precipitation of the wax.

Emulsification can be carried out down to a much smaller toner particle size, of the order of 100 to 500 nm, due to the shearing imparted thereupon with a homogenizer or the like. Stabilizing the emulsion in this state and then removing the solvent allows to obtain a suspension having the base microparticles at the nm level dispersed therein. A dispersant is preferably used for emulsification. The dispersant, however, affects greatly the charge performance of the toner, and hence a dispersant capable of eliciting emulsion stabilization when added in as small an amount as possible may be selected.

In the production method of the present invention, emulsion stabilization is preferably accomplished without using the dispersant, but instead, a neutralizer (aqueous solution of an alkali such as sodium hydroxide) for neutralizing the acid groups (carboxyl groups and the like) in the binder resin is preferably used to impart hydrophilicity to the binder resin itself. A specific example of the neutralizer is sodium hydroxide. Emulsion stabilization is carried out by mixing the neutralizer with the aqueous medium or with the resin solution, or by adding the neutralizer after mixing the resin solution with the aqueous medium.

The solvent can be removed once the emulsion is stabilized. To remove the organic solvent from the emulsion, a conventionally known method such as air-blowing, heating, vacuum, or a combination thereof may be employed. For instance, the emulsion is heated in an inert gas atmosphere, from room temperature to 90° C., preferably from 65 to 80° C., until about 80 to 95 wt % of the initial amount of the organic solvent is removed. As a result, the organic solvent is removed from the aqueous medium, thereby to prepare a suspension (slurry) in which resin microparticles of the binder resin having the colorant and wax uniformly dispersed thereon is dispersed in an aqueous medium. For instance, the volume average particle size of the resin microparticles of the base microparticles ranges preferably from about 50 nm to about 1000 nm. A volume average particle size smaller than 50 nm tends to require a greater amount of aggregating agent during aggregation. A volume average particle size in excess of 1000 nm makes it more difficult to achieve toner base particles having a sharp particle size distribution during aggregation.

The average particle size of the base microparticles can be determined by dynamic light scattering (laser Doppler), using a particle size analyzer Nanotrac™ UPA150 (by Nikkiso Co. LTD.). The specific method used may be the method set forth in the examples.

Emulsification may be carried out by blending the resin solution into the aqueous medium or by blending the aqueous medium into the resin solution. A polyester resin is used in the present invention, and hence neutralization can be carried out by blending beforehand an alkaline aqueous solution and an amine-based solvent into a resin solution, and blending then water into the resin solution. Also, water may be blended into a resin solution neutralized beforehand.

(Production of Base Particles) (Step S30)

In step S30, the base microparticles obtained in step S20 are aggregated to yield base particles. Firstly, the solids concentration in the suspension is adjusted by diluting the base microparticle suspension with water, as the case may require. In the suspension, any among an inorganic metal salt for emulsion aggregation (aggregating agent), an alkali (dispersion enhancer) and surfactant (dispersion enhancer) including a nonionic surfactant and an anionic surfactant may be used. Examples of the aggregating agent include, for instance, cationic surfactants, inorganic metal salts such as calcium nitrate, and polymers of inorganic metal salts such as polyaluminum chloride. In the present invention there is preferably used an inorganic metal salt or a polymer thereof. Examples of dispersion enhancers include, for instance, known dispersion enhancers such as aqueous solutions of alkalis like sodium hydroxide. Examples of nonionic surfactants used as dispersion enhancers include, for instance, polyoxyethylene polyoxypropylene glycol, polyoxyalkylene decyl ether, polyoxyalkylene tridecyl ether, polyoxyethylene isodecyl ether, polyoxyalkylene lauryl ether, polyoxyethylene alkyl ethers and the like, preferably polyoxyethylene polyoxypropylene glycol. Examples of anionic surfactants used as dispersion enhancers include fatty acid salts, alkyl sulfates, alkylarylsulfonates, alkylnaphthalenesulfonates, dialkylsulfonates, dialkylsulfosuccinates, alkyldiaryl ether disulfonates, alkylphosphates, polyoxyethylene alkyl ether sulfates, polyoxyethylene alkylaryl ether sulfates, naphthalenesulfonic acid-formalin condensates, polyoxyethylene alkylphosphates and glycerol borate fatty acid esters.

During aggregation, an aqueous solution of the aggregating agent adjusted for instance to 0.01 to 1.0N (normal), preferably 0.05 to 0.5N (normal), is added, with stirring, at a ratio of for instance 0.1 to 10 parts by weight, preferably 0.5 to 5 parts by weight relative to 100 parts by weight of the suspension. The stirring method is not particularly limited. For instance, the suspension is dispersed in a high-speed dispersing apparatus such as a homogenizer, after which mixing proceeds using a stirrer equipped with stirring blades, to completely fluidize the suspension thereby. As the mixing blade there is used a well-known blade such as a flat turbine blade, a propeller blade or an anchor blade. Stirring may also be carried out using an ultrasonic disperser. The liquid temperature during stirring is, for instance, 10 to 50° C., preferably 20 to 30° C., and the stirring time is for instance 5 to 60 minutes, preferably 10 to 30 minutes. Thereafter, the suspension is preferably heated, to homogenize the aggregated state. Heating is carried out for instance up to a temperature at which particles do not fuse. In terms of preventing formation of coarse particles, heating is carried out preferably at a liquid temperature lower than the Tg of the base microparticles. For instance, the suspension is heated at a temperature of 35 to 60° C., more preferably temperature of about 40 to about 45° C.

Once the base microparticles have formed aggregates of desired size, an aggregation terminator is then added. The volume average particle size of the base particles ranges for instance from about 6 μm to about 10 μm. As the aggregation terminator an alkali aqueous solution or an ionic surfactant having an inverse polarity to that of the aggregating agent is used. For instance, an aqueous solution of sodium hydroxide is added as the aggregation terminator. The size of the base particles can be measured in accordance with the Coulter method using, for instance, a Coulter Multisizer II (by Beckman Coulter Inc.). The method set forth in the examples may be employed as the specific measurement method.

After addition of the aggregation terminator, the aggregate is fused by heating. That is, the suspension is heated, under continued stirring, at a temperature not lower than the glass transition temperature (Tg) of the resin. For instance, the suspension is heated at 55 to 100° C. preferably at 65 to 95° C. For instance, the suspension is heated up to a liquid temperature of 90° C. The aggregate undergoes shape changes when fusing, and hence heating and stirring are discontinued once the desired shape is achieved, followed by recovery of the suspension.

Examples of the aggregation terminator include alkaline metals such as sodium hydroxide and potassium hydroxide. An ionic surfactant may also be employed. When adding the aggregation terminator, an alkaline metal aqueous solution adjusted for instance to 0.01 to 5.0N (normal), preferably 0.1 to 2.0N (normal), is added at a ratio of for instance 0.5 to 20 parts by weight, preferably 1.0 to 10 parts by weight relative to 100 parts by weight of the suspension, while the suspension is continuously stirred.

The production method of the present invention is particularly effective when adding an alkali, an inorganic metal salt and a nonionic surfactant in the step of preparing the base particle suspension. In the present invention, the amount of these additives can be reduced in the base particle suspension by controlling the conductivity of the base particle suspension. This allows, as a result, diminishing the adverse effect of the additives on the charge characteristics of the positive charging toner.

(Preparation of a Base Particle Suspension) (Step S40)

In step S40, a base particle suspension having a conductivity not higher than 70 μS/cm is prepared. The base particle suspension obtained in step S30 after aggregation discontinuation comprises ordinarily base particles, formed to toner size, and the various additives, used for aggregating the base microparticles, all of which are dispersed or dissolved in the aqueous solvent. Controlling the conductivity of the aforesaid base particle suspension so as to take on the above conductivity allows to effectively suppress varieties of additives from precipitating and/or adhering to the base particle surface, which may occur when positive charge control resin microparticles are supplied to the base particle suspension. Hence, loss of positive charge characteristics of the toner is prevented as a result.

A positive charging toner having prominent charge characteristics can be obtained when the conductivity of the base particle suspension is not higher than 70 μS/cm. When the conductivity exceeds the above value, a positive charging toner having good charge characteristics cannot be obtained, even by washing after external addition of the charge control resin microparticles. More preferably, the conductivity is not higher than 40 μS/cm. The conductivity of the base particle suspension is ordinarily not lower than 0.5 μS/cm.

At least part of the aqueous medium for suspending the base particles is preferably replaced in order to keep the conductivity of the base particle suspension obtained in step S30 at or below the above predetermined conductivity. Specifically, at least part of only the aqueous medium of the base particle suspension is removed and replaced by an aqueous medium having low conductivity (also referred to hereinafter as low-conductivity medium). More specifically, the base particles and the suspension are subjected to solid-liquid separation, after which the base particles, i.e. the solid component, are washed with a low-conductivity medium, and are re-suspended in, for instance, the washing liquid or in a low-conductivity medium used in the subsequent step. The above procedure is repeated as needed, thereby to allow obtaining a base particle suspension of desired conductivity. Solid-liquid separation may be performed in accordance with a known method. The solid-liquid separation method is preferably filtration, such as vacuum filtration or pressure filtration, or centrifugation. Filtration may involve vacuum filtration using a continuous belt filter, or pressure filtration using a filter press. Centrifugation may involve centrifugation using a filtering material.

Other than as described above, replacement of the aqueous medium of the base particle suspension by the low-conductivity medium may involve diluting the base particle suspension with the low-conductivity medium. Such replacement can be embodied in numerous ways, depending on the solid-liquid separation method. The low-conductivity medium used is preferably an aqueous medium, ordinarily of high purity, having a conductivity sufficiently lower than 70 μS/cm, such as pure water or distilled water. The aqueous medium used is water or the like having more preferably a conductivity not higher than 10 μS/cm, yet more preferably not higher than 5 μS/cm, and even yet more preferably not higher than 1 μS/cm. The dispersion medium used for re-suspension is preferably a dispersion medium having the above conductivity value.

A base particle suspension having the intended conductivity can be obtained by re-suspending the washed base particles in the dispersion liquid such as water (having the conductivity of no higher than 10 μS/cm). Conductivity need not necessarily be adjusted by washing if the conductivity of the base particle suspension obtained in step S30 is not higher than 70 μS/cm. Nevertheless, the conductivity is preferably further lowered by washing, in order to obtain a positive charging toner having yet better charge characteristics.

The conductivity of the base particles can be measured using for instance a commercially available conductivity meter. The measurement conditions may involve, for instance, cooling the base particle suspension to 30° C., and carrying out measurements at a temperature from 25° C. to 30° C.

The surfactant content in the base particle suspension is preferably no greater than 300 ppm. Whether ionic or non-ionic, surfactants exert a great influence on the charge characteristics of the positive charging toner. The positive charge control resin microparticles can be fixed uniformly when the surfactant concentration is no greater than 300 ppm. On the other hand, a surfactant concentration in excess of 300 ppm hampers fixing of the positive charge control resin microparticles onto the base particles, thereby making it more difficult to achieve uniform fixing of the positive charge control resin microparticles. From the viewpoint of printing durability, in particular, fogging becomes then more likely to occur.

The surfactant concentration in the base particle suspension can be measured as follows. Specifically, the base particle component alone is filtered off the base particle suspension, the total weight of the obtained liquid is measured, and 200 g thereof are poured into a beaker and are dried by evaporation. The weight of the residual nonvolatile component is measured to calculate the amount of nonvolatile component in the filtrate. The nonvolatile component is recovered next, and about 10 mg thereof undergo a thermogravimetric analysis. The thermogravimetric analyzer used may be for instance TG/DTA 6220 (by SII NanoTechnology Inc.), or any instrument capable of performing thermogravimetric analyses with commensurate precision. About 10 mg of the sample are weighed in a dedicated aluminum crucible that is then heated in an inert atmosphere (nitrogen), at a rate of 10° C./minute, up to the decomposition temperature of the surfactant used. The reduction ratio is read out assuming that the amount of component whose weight is reduced by decomposition over the decomposition temperature range of used surfactants (from the temperature at which decomposition starts up to the temperature at which decomposition ends), corresponds to the amount of the surface component. The ratio of weight reduction fraction is calculated on the basis of the total amount of nonvolatile component, to calculate the amount of surfactant in the filtrate. The amount of surfactant in the filtrate gives the surfactant concentration in the base particle suspension. Thermogravimetric analysis can be accurately carried out by knowing beforehand the decomposition temperature of all the surfactants used.

(Production of Toner Base Particles)

The present step is a step of producing toner base particles by mixing the base particle suspension and the charge control resin microparticles to cause the charge control resin microparticles to adhere to the surface of the base particles. Impurities that destabilize fixing of the charge control resin microparticles, or that destabilize charge characteristics thereafter, are removed by controlling beforehand the conductivity of the base particle suspension. The present toner base particle production step, therefore, allows charge control resin microparticles to be uniformly fixed to the surface of the base particles, and allows obtaining toner base particles in which adhesion of impurities is inhibited. The preparation of charge control resin microparticles used in the present step will be explained first, and the production of the toner base particles next.

(Preparation of a Charge Control Resin Microparticle Suspension)

The production method of the present invention utilizes a method for applying charge control resin microparticles onto the surface of base particles. Applying and fixing charge control resin microparticles to the surface of the base particles allows to effectively impart charge using small amounts of charge control agent. Also, carrying out adhesion/fixing to the base particle surface within a liquid is more suitable for homogeneous treatment than a dry method. In the explanation below, the charge control resin microparticles are exemplified as microparticles of a styrene-acrylic copolymer comprising quaternary ammonium salt groups.

Firstly, the charge control resin is mixed with water and an organic solvent capable of dissolving or swelling the charge control resin, and the resulting mixture is emulsified in a high-speed stirrer such as a homogenizer. Depending on the polar group structure of the charge control resin, a stable emulsified state can be achieved, without adding a dispersant, when the charge control resin has such polar groups. A suspension in which the charge control resin microparticles are dispersed in the aqueous medium can be obtained by removing the organic solvent component from the emulsion using a known method such as heating under reduced pressure. The size of the charge control resin microparticles can be controlled by adjusting the ratio between resin, solvent and water and by adjusting shear forces in the stirrer. The size of the charge control resin microparticles can also be controlled on the basis of, for instance, the amount of polar groups or the molecular weight of the resin. The average particle size of the charge control resin microparticles can range, for instance, from 50 nm to 250 nm. The average particle size of the charge control resin microparticles can be determined by laser scattering using a Microtrac particle size analyzer Nanotrac™ NPA150 (UPA150, by Nikkiso Co. LTD.). The specific method used may be the method set forth in the examples.

The above-described method for producing a charge control resin microparticle suspension allows decreasing the amount of residual monomers in a charge control resin produced through solution polymerization. That is, the above-described method allows preparing a charge control resin microparticle suspension comprising virtually no monomer component, even in the case of a resin obtained through solution polymerization. Charge control resin microparticles can thus be obtained are suitable for the method for producing a positive charging toner of the present invention. Resins produced by emulsion polymerization or soap-free emulsion polymerization can also be used as the resin of the charge control resin microparticles.

(Mixing of the Base Particle Suspension and the Charge Control Resin Microparticle Suspension)

Predetermined amounts of the base particle suspension and the charge control resin microparticle suspension are mixed together, and are stirred or the like in such a manner that the base particles and the charge control resin microparticles come into good contact with each other. Thereafter, the resulting mixture is heated under predetermined conditions, thereby to produce toner base particles upon which the charge control resin microparticles are fixed to the surfaces thereof. Preferably, the charge control resin microparticles are embedded to a certain extent into the toner surface. To that end, the charge control resin microparticles are preferably fixed at a liquid temperature around the Tg of the base particles. For instance, if the Tg of the base particles is 55° C., then the charge control resin microparticles are preferably mixed and then heated and stirred at a temperature of 55° C. for 15 to 60 minutes.

In the step of producing the toner base particles, a charge control resin microparticle coefficient represented by formula (1) below is preferably not smaller than 0.0144.

Charge control resin microparticle coefficient= [(charge control resin microparticle amount(mg)/ base particle amount(mg)×100]conductivity of the base particle suspension (μS/cm) (1)

Note that in the above formula (1), the charge control resin microparticle amount is the amount of charge control resin microparticles contained in the total amount of charge control resin microparticle suspension used, and the base particle amount is the amount of base particles contained in the total amount of base particle suspension used).

Charge control resin microparticles capable of exhibiting stable charge characteristics can be obtained, and positive charging toner having good charge characteristics can be achieved, by using a suspension containing charge control resin microparticles such that the charge control resin microparticle coefficient in formula (1) above is not smaller than 0.014. In the present production method, thus, the amount of charge control resin microparticles used can be optimized or reduced by specifying the amount of charge control resin microparticles to be used by taking the controlled conductivity of the base particle suspension into account as a guide thereof.

The base particle amount and charge control resin microparticle amount in formula (1) can be measured respectively as the nonvolatile component amount in the base particle suspension and the charge control resin microparticle suspension used in the production of the base particles. To measure the nonvolatile component amount in the suspension, the nonvolatile component amount can be calculated by measuring the total liquid amount, sampling 2 to 20 g thereof into an aluminum container and drying the sample by evaporation by placing the container in a dryer at 50° C. The sampling amount in the aluminum container can be decided by estimating roughly the nonvolatile component amount. When the nonvolatile component amount is expected to be large (base particle suspension or charge control resin microparticle suspension), there can be sampled about 2 g, In the above-described base particle production, the toner base particles, comprising charge control resin microparticles on the surface of the base particles, are obtained in the form of a suspension comprising the toner base particles.

(Washing)

In the washing process, the toner base particles are recovered, for instance by filtering the obtained toner base particle suspension, and by washing. As is the case during adjustment of the conductivity of the base particle suspension already explained, washing is carried out by replacing at least part of the toner base particle suspension by a low-conductivity medium. This can be accomplished, specifically, through solid-liquid separation of the toner base particle suspension and through re-suspension using a low-conductivity medium, for an appropriate number of times. Washing is preferably carried out in such a manner that a suspension containing 10 wt % solids of the ultimately obtained toner base particles has a conductivity not higher than 5 μS/cm, more preferably a conductivity not higher than 3 μS/cm. A base particle suspension obtained after the above steps and having such conductivity comprises a sufficient amount of charge control resin microparticles, while avoiding or limiting the influence of impurities such as surfactants. Preferably, the above suspension of toner base particles is prepared by using water having a conductivity not higher than 1 μS/cm as a dispersion liquid.

The toner base particle suspension whose conductivity is to be measured is preferably a suspension of toner base particles at a stage immediately before a drying operation that precedes toner production, namely a suspension at the stage where toner base particles, obtained in the form of a wet cake through solid-liquid separation and re-suspension over a suitable number of times, is re-suspended in a low-conductivity medium such as water.

The toner base particles thus ultimately obtained are recovered and dried, to yield toner base particles having charge control resin microparticles fixed on the surface. For instance, drying is performed preferably to a water content not higher than 1 wt %. The drying method is not particularly limited, and ordinary methods may be employed. Drying may be accomplished, for instance, by fluidized bed drying or air stream drying (e.g. Flash Jet Dryer, by Seishin Enterprise Co., LTD.).

(Toner Production)

The toner base particles thus obtained as a result of the above operations are sufficiently charged themselves. However, it is preferable to cause an external additive to adhere to the surface of the toner base particles, with a view to enhancing fluidity and storage stability in the toner. Preferably in particular, an inorganic oxide hydrophobized using a silane coupling agent or the like is externally added. After addition of the external additive, the toner base particles may be sorted with a sieve or the like to yield the final toner.

The above-described method for producing a positive charging toner of the present invention affords a positive charging toner having good charge characteristics. That is, the initial charge rise of the toner is likewise excellent, since the toner holds uniformly a sufficient amount of positive charging toner. The toner is thus impervious to undesirable effects that may cause image defects such as fogging or the like. At the same time, impurities such as surfactants are reduced in the toner. As a result, charge characteristics can be preserved stably and clear and fine images can be formed stably over long periods of time.

The positive charging toner obtained in accordance with the method for producing a positive charging toner of the present invention can be preferably used as a non-magnetic mono-component toner (i.e. single component developer), but can also be used as a two-component toner, for instance by being blended with a suitable carrier. As the carrier there can be used glass beads, steel shot or the like coated with a resin, in the case of cascade developing, or ferrite, iron dust or so-called binder-type carriers in the case of magnetic brush developing.

The positive charging toner obtained in accordance with the method for producing a positive charging toner of the present invention can be used as toner in electrophotographic and electrostatic-recording image forming apparatuses such as all manner of monochrome/color laser printers, fax machines, copiers and multifunction machines.

The present invention will be explained in more detail next on the basis of examples. The invention, however, is not limited to or by the examples below. In the examples, "parts" denote "parts by weight" and "%" denotes weight percent.

EXAMPLES

In the below examples, eight types of toner (toners 1 to 5 are examples of the present invention and toners 6 to 8 are comparative examples) were prepared. The various parameters in the production of each toner are given in Table 1. The measurements methods for the various parameters in the toner production process are as follows.

(1) Glass Transition Temperature (DSC)

Glass transition temperature was measured using a differential scanning calorimeter (DSC6220; by SII NanoTechnology Inc.). About 5 mg of the sample was placed in a dedicated aluminum crucible that was heated from −10° C. to 170° C. at a temperature rise rate of 10° C./min (1st run). The heated sample was then cooled to −10° C. at a rate of 10° C./min, and was heated again to 170° C. at the rate of 10° C./min (2nd run). As a reference, a 9.7 mg aluminum plate was placed in the same aluminum crucible. The median glass transition temperature in the 2nd run was taken as the glass transition temperature Tg in the present invention.

(2) Molecular Weight

The resin component was dissolved in THF, the insoluble component was filtered off using DISMIC™ (diameter 0.2 μm, made of PTFE, by ADVANTEC), and only the THF solution was collected. The THF solution was measured using a GPC instrument, to calculate the molecular weight distribution in terms of standard polystyrene.

(3) Conductivity

The liquid to be tested was cooled to a temperature not higher than 30° C., and then conductivity was measured at a temperature of 25° C. to 30° C. using a conductivity meter (COND METER ES-51, by Horiba).

(4) Particle Size Measurement Method (Size of the Base Microparticles Particle and Charge Control Resin Microparticles)

The instrument used was Nanotrac™ UPA150, by Nikkiso Co. LTD. The base microparticles containing carbon were measured with a solvent refractive index of 1.33 (water) and a particle refractive index of 1.91. The charge control resin microparticles not containing carbon were measured with a particle refractive index of 1.51. The suspension in which the microparticles were dispersed was adjusted to a suitable concentration falling within a concentration range appropriate for the measurement conditions in the measurement unit of the instrument. The sample was dripped using a dropper, and was measured thrice over a measurement time of 120 seconds. The median particle size was taken as the average size.

(Size of the Base Particles)

The size of the base particles was measured using a Coulter Multisizer II (by Beckman Coulter Inc.) to an aperture diameter of 100 μm, as the measurement instrument. Specifically, 0.2 g of base particles were dripped into and mixed with 50 cc of a 0.1% aqueous solution of a dispersant (Pelex OT-P, by Kao Corporation.) in distilled water, to prepare a suspension using, as needed an ultrasonic disperser or the like. Then, three to five drops of the suspension were dripped, using a 2 ml dropper, into the above measurement instrument, where about 50000 particles were measured. The median particle size in the volume-basis particle size distribution was taken as the average size.

(5) Nonvolatile Component (Solids) in the Suspension

The nonvolatile component amount in the suspension was calculated by measuring the total liquid amount, sampling 2 to 20 g thereof into an aluminum container, and placing the container in a dryer at 50° C., to dry the sample by evaporation.

Samples of 2 g were taken from the base particle suspension and the charge control resin microparticle suspension. The nonvolatile component concentration can be estimated beforehand. Thus, about 20 g were sampled and vaporized from liquids with abundant nonvolatile component (for instance, the base microparticle suspension), or with little nonvolatile component (for instance, nonvolatile component in the filtrate).

(6) Amount of Surfactant in the Base Particle Suspension

The base particle component alone was filtered off the base particle suspension, the total weight of the obtained liquid was measured, and 200 g thereof were poured into a beaker and dried by evaporation. Since there remained a nonvolatile component, the amount thereof was measured to calculate the nonvolatile component in the filtrate. The nonvolatile component was recovered and about 10 mg thereof underwent thermogravimetric analysis. The thermogravimetric analyzer used was TG/DTA 6220 (by SII NanoTechnology). About 10 mg of sample were weighed in a dedicated aluminum crucible that was then heated in an inert atmosphere (nitrogen), at a temperature rise rate of 10° C./minute, up to 300° C. The temperature was kept at 300° C. for 15 minutes. All the surfactants used decompose at that temperature, and hence the reduction ratio was read assuming the weight reduction under these conditions to correspond to the surfactant component. The ratio of weight reduction fraction was calculated on the basis of the total nonvolatile component amount, to calculate the amount of surfactant in the filtrate.

TABLE 1

| | | Base particle suspension | | CCR suspension | | Base particle suspension | | Toner base | | CCR micro- | | | | | HH |
|---|---|---|---|---|---|---|---|---|---|---|---|---|---|---|---|
| | | Type | Average particle size μm | Type | Average particle size μm | Conductivity μS/cm | Surfactant ppm | particle suspension Conductivity μS/cm | Solids ratio wt % | particle coefficient H/E | Initial charge amount μC/g | Initial fogging | Paper fogging ΔY | HH durability fogging | durability fogging ΔY |
| Ex. 1 | 1 | A | 8.1 | A | 110 | 3.3 | 7 | 2.4 | 0.25 | 0.076 | 50.1 | ○ | 0.2 | ○ | 0.5 |
| Ex. 2 | 2 | B | 7.8 | A | 110 | 13 | 21 | 2.5 | 1.2 | 0.092 | 65.3 | ○ | 0.3 | ○ | 0.5 |
| Ex. 3 | 3 | B | 7.8 | B | 210 | 15 | 50 | 3 | 1.2 | 0.080 | 50.3 | ○ | 0.3 | ○ | 0.6 |
| Ex. 4 | 4 | A | 8.1 | A | 110 | 20 | 31 | 4.5 | 1 | 0.050 | 65.2 | ○ | 0.2 | ○ | 0.5 |
| Ex. 5 | 5 | B | 7.8 | A | 110 | 70 | 220 | 3.1 | 1 | 0.014 | 56.8 | ○ | 0.7 | ○ | 0.9 |
| Comp. ex. 1 | 6 | B | 7.8 | A | 110 | 100 | 320 | 2.4 | 1 | 0.010 | 50.8 | Δ | 1.1 | X | 2.5 |
| Comp. ex. 2 | 7 | A | 8.1 | A | 110 | 400 | 590 | 3.6 | 1.5 | 0.004 | 40.1 | Δ | 1.8 | X | 3.4 |
| Comp. ex. 3 | 8 | A | 8.1 | A | 110 | 10 | 17 | 15 | 1.2 | 0.120 | 65.8 | ○ | 0.9 | X | 2.8 |

CCR: charge control resin

HH: high-temperature high-humidity environment

Solids ratio (wt %): CCR particle amount/base particles × 100

CCR microparticle coefficient: solids ratio/base particle suspension conductivity Paper fogging: whiteness difference ΔY = Y1 − Y0

Whiteness meter: Tokyo Denshoku TC-6DS

A white solid pattern was printed on A4 XX 4200 paper, whiteness Y1 of the four corners and center of the printed product were measured using the whiteness meter.

The whiteness Y0 of fresh paper was measured, and the whiteness difference between Y0 and Y1 yielded the fogging value.

A difference value in excess of 2 corresponds to a level in which presence of fogging can be appreciated visually.

(Preparation of a Base Particle Suspension A)

A mixture comprising 15 parts of a polyester resin FC1565 (Tg: 64° C.; Mn 5000; Mw 98000; gel fraction 1.5 wt %; acid value 6.1 mgKOH/g; by Mitsubishi Rayon Co. LTD.), 15 parts of carbon black #260 (by Mitsubishi Chemical Corporation.) and 70 parts of MEK, was pre-dispersed for 10 minutes at 10000 rpm in a homogenizer (Silent Crusher M, Shaft 18F, by Heidolph Electro GmbH & Co KG). Thereafter, 100 parts of this colorant dispersion and 450 parts of 1 mm-diameter zirconia beads were charged into a bead mill (RMB-04; by Imex Co. Ltd.), where dispersion was carried out for 60 minutes at a stirring speed of 2000 rpm. The resulting colorant dispersion was recovered; then 60 parts of the colorant dispersion were mixed slowly with 690 parts of MEK, after which further 153 parts of FC 1565 and 9 parts of Unistar H476 (by NOF Corporation) were mixed in under stirring. The whole was heated under stirring at a liquid temperature of 50° C., to prepare a resin solution.

Next 900 parts of the resin solution, 900 parts of distilled water heated at 50° C. and 9 parts of a 1N sodium hydroxide aqueous solution were mixed and emulsified in a homogenizer (Shaft 22F) for 20 minutes at 15000 rpm. Be obtained emulsion was transferred to a 2 L separable flask, where MEK was removed by heating under stirring for 140 minutes at 75° C. while blowing nitrogen into the gas phase, to yield a base microparticles suspension. The volume average size of the base microparticles was 290 nm, as a median size.

The base microparticle suspension was diluted with distilled water to adjust the solids concentration to 10%. Thereafter, 2.6 parts of a nonionic surfactant (Noigen XL50; by Dal-Ichi Kogyo Seiyaku Co. Ltd.) were added to 1600 parts of the diluted suspension, and then 35 parts of a 0.2N aluminum chloride aqueous solution were added as an aggregating agent. The whole was mixed and stirred in a homogenizer at 8000 rpm, and was then heated at a liquid temperature of 44° C., while being stirred at 300 rpm with six flat turbine blades (diameter: 75 mm), to aggregate thereby the base microparticles. Thereafter, 46 parts of a 0.2N sodium hydroxide aqueous solution were added as an aggregation terminator. The resulting mixture was then heated to a liquid temperature of 90° C. and was stirred for about 6 hours. The obtained base particles had a volume average particle size Dv of 8.1 μm and a Dv/Dn of 1.17 (Dn being the number average particle size).

(Method for Producing a Charge Control Resin A)

A 1 L separable flask was charged with 225 parts of styrene monomers, 15 parts of an acrylic monomer (dimethylaminoethyl methacrylate methyl chloride quaternary salt (Acryl ester DMC, by Mitsubishi Rayon Co. LTD.)), 30 parts of butyl acrylate, 5 parts of an azo-based polymerization initiator (V65, by Wako Pure Chemical Industries Ltd.), and 250 parts of MEK. The mixture was then bubbled for 30 minutes by blowing in nitrogen gas at a flow rate of 50 ml/min, and was then heated at a liquid temperature of 70° C. while blowing nitrogen into the gas-phase at a flow rate of 30 ml/min. The mixture was polymerized over about 10 hours under stirring at 150 rpm with six flat turbine blades. After the polymerization reaction, the reaction product was placed in a vacuum heating oven to remove the MEK solvent and yield a charge control resin. The resin had a Tg of 66° C. and a Mw of 13000.

(Preparation of a Charge Control Resin Microparticle Suspension A)

A mixture of 160 parts of the obtained charge control resin, 740 parts of MEK and 900 parts of distilled water was emulsified in a homogenizer under stirring for 20 minutes at 16000 rpm. Thereafter, MEK was evaporated off through heating under reduced pressure at a liquid temperature of 60° C. The microparticles in the obtained charge control resin microparticle suspension had a volume average size 110 nm. The nonvolatile component in the suspension was 19.9 wt %.

Example 1

(Production of Toner 1)

(Adjustment of the Conductivity of the Base Particle Suspension A)

The base particle suspension A was vacuum-filtered to remove water and was further rinsed with 500 parts of distilled water (liquid temperature 20° C.) having a conductivity of 0.8 μS/cm. Thereafter, the base particle cake was re-suspended using identical distilled water, to prepare 1600 parts of a base particle suspension. The conductivity of the suspension was 3.3 μS/cm (liquid temperature 23° C.). The surfactant concentration in the suspension was 7 ppm.

(Fixing of the Charge Control Agent)

A mixture of 2.0 parts of the charge control resin microparticle suspension A in 1600 parts of the above suspension was mixed and stirred for 30 minutes at a liquid temperature of 55° C., Stirring was carried out at 170 rpm using six flat turbine blades. Thereafter, the resulting suspension was vacuum-filtered and was rinsed with 1000 parts of distilled water to yield a toner base particle cake containing 43 wt % of water. Next, about 23 g of the toner base particle cake were mixed with 77 g of distilled water (conductivity 0.8 μS/cm, liquid temperature 23° C.), to prepare a toner base particle suspension having about 10% solids. The measured conductivity of this suspension was 2.4 μS/cm. Toner base particles having a water content lower than 1% were obtained by drying the above toner base particle cake in a drier (temperature in the drier 50° C.) for 24 hours or longer.

External addition was carried out next by blending 100 parts of the toner with 1 part of hydrophobic silica HVK2150 (by Clariant K.K.) and 1.5 parts of NA50H (by Nippon Aerosil Co. Ltd.), and by stirring the blend for 3 minutes at 2500 rpm in a Mechanomill (by Okada Seiko Co. Ltd.). After external addition, coarse silica aggregates were removed from the toner using a sieve, to yield a non-magnetic monocomponent positive charging toner.

Example 2

(Production of Toner 2)

(Preparation of a Base Particle Suspension B)

A mixture comprising 15 parts of a polyester resin FC1494 (Tg: 63° C.; Mn 5100; Mw 150000; gel fraction 1.2 wt %; acid value 6.5 mgKOH/g; by Mitsubishi Rayon Co. LTD.), 15 parts of carbon black #260 (by Mitsubishi Chemical Corporation.) and 70 parts of MEK, was pre-dispersed for 10 minutes at 10000 rpm in a homogenizer (Silent Crusher M, Shaft 18F, by Heidolph Electro GmbH & Co. KG). Thereafter, 100 parts of this colorant dispersion and 450 parts of 1 mm-diameter zirconia beads were charged into a bead mill (RMB-04; by Imex Co. Ltd.), where dispersion was carried out for 60 minutes at a stirring speed of 2000 rpm. The resulting colorant dispersion was recovered; then 60 parts of the colorant dispersion were mixed slowly with 690 parts of MEK, after which further 153 parts of FC 1494 and 9 parts of Unistar H476 (NOF Corporation) were mixed in under stirring. The whole was heated under stirring at a liquid temperature of 50° C., to prepare a resin solution.

Then, 900 parts of the resin solution, 900 parts of distilled water heated at 50° C. and 9 parts a 1N sodium hydroxide aqueous solution were mixed and emulsified in a homogenizer (Shaft 22F) for 20 minutes at 13000 rpm. The obtained emulsion was transferred to a 2 L separable flask, where MEK was removed by heating under stirring for 140 minutes at 75° C. while blowing nitrogen into the gas phase, to yield a base microparticle suspension. The volume average size of the base microparticles was 320 nm, as a median size.

The base microparticle suspension was diluted with distilled water to adjust the solid component concentration to 10%. Thereafter, 5.2 parts of a nonionic surfactant (Noigen XL50; by Dai-Ichi Kogyo Seiyaku Co. Ltd.) were added to 1600 parts of the diluted suspension, and then 38 parts of a 0.2N aluminum chloride aqueous solution were added as an aggregating agent. The whole was mixed and stirred in a homogenizer at 8000 rpm, and was then heated at a liquid temperature of 44° C., while being stirred at 300 rpm with six flat turbine blades (diameter: 75 mm), to aggregate thereby the base microparticles. Thereafter, 48 parts of a 0.2N sodium hydroxide aqueous solution were added as an aggregation terminator. The resulting mixture was then heated to a liquid temperature of 90° C. and was stirred for about 6 hours. The obtained base particles had a volume average particle size Dv of 7.8 μm and a Dv/Dn of 1.18.

The base particle suspension B was vacuum-filtered to remove water and was rinsed with 250 parts of distilled water. Thereafter, the base particle cake was re-suspended using distilled water, to prepare 1600 parts of a base particle suspension. The conductivity of the suspension was 13 μS/cm. Surfactant concentration was 21 ppm. Toner 2 was obtained then in the same way as toner 1, but adding herein 9.6 parts of the charge control resin microparticle suspension A to 1600 parts of the above suspension.

Example 3

(Production of Toner 3)

(Preparation of a Charge Control Resin Microparticle Suspension B)

A charge control resin microparticle suspension B was prepared in the same way as in the suspension A, except that herein the charge control resin A was mixed at the same composition ratio as the charge control resin microparticle suspension A, and that stirring in the homogenizer took place at 13000 rpm. The volume average size of the microparticles in the suspension was 210 nm. The nonvolatile component was 20.1 wt %.

The base particle suspension B was vacuum-filtered to remove water and was rinsed with 200 parts of distilled water. Thereafter, the base particle cake was re-suspended using distilled water, to prepare 1600 parts of a base particle suspension. The conductivity of the suspension was 15 μS/cm. Surfactant concentration was 50 ppm. Toner 3 was obtained then in the same way as toner 1, but adding herein 9.6 parts of the charge control resin microparticle suspension B to 1600 parts of the above suspension.

Example 4

(Production of Toner 4)

The base particle suspension A was vacuum-filtered to remove water and was further rinsed with 100 parts of distilled water having a conductivity of 0.8 μS/cm. Thereafter, the base particle cake was re-suspended using identical distilled water, to prepare 1600 parts of a base particle suspension. The conductivity of the suspension was 20 μS/cm. The surfactant concentration in the suspension was 31 ppm. Toner 4 was obtained then in the same way as toner 1, but adding herein 8 parts of the charge control resin microparticle suspension A to 1600 parts of the above suspension.

Example 5

(Production of Toner 5)

The base particle suspension B was vacuum-filtered and the solvent in the suspension was removed to some extent, to prepare a dense base particle suspension having a water content of 58 wt %. Distilled water was added to this base particle suspension, to prepare 1600 parts of a suspension. The conductivity of the suspension was 70 μS/cm. Surfactant concentration was 220 ppm. Toner 5 was obtained from this suspension in the same way as in the case of toner 4.

Comparative Example 1

(Production of Toner 6)

The base particle suspension B was vacuum-filtered and the solvent in the suspension was removed to some extent, to prepare a base particle suspension having a water content of 65 wt %. Distilled water was added to this base particle suspension, to prepare 1600 parts of a suspension. The conductivity of the suspension was 100 μS/cm. The surfactant concentration in the suspension was 320 ppm. Toner 6 was obtained from this suspension in the same way as in the case of toner 5.

Comparative Example 2

(Production of Toner 7)

The measured conductivity of the base particle suspension A was 400 μS/cm. Surfactant concentration was 590 ppm. Toner 7 was obtained from this suspension in the same way as in the case of toner 6, by adding 12.1 parts of the charge control resin microparticle suspension A to 1600 parts of the above suspension.

Comparative Example 3

(Production of Toner 8)

The base particle suspension A was vacuum-distilled and was rinsed with 250 parts of distilled water, after which it was re-suspended to prepare 1600 parts of a suspension. The conductivity of the suspension was 10 μS/cm. Surfactant concentration was 17 ppm.

Charge control resin microparticles were fixed to the surface of base particles in the same way as in the case of toner 1, by adding 9.6 parts of the charge control resin microparticle suspension A to 1600 parts of the above suspension. Thereafter, the suspension was vacuum-filtered. The water content of the toner base particle cake was 45 wt %. The toner cake was recovered without rinsing. A suspension resulting from mixing about 20 g of the toner cake and 80 g of distilled water exhibited a conductivity of 10 μS/cm. These toner base particles were dried and yielded a toner through the same external addition as in the case of toner 1.

Toners 1 to 8 thus produced were evaluated for printing image quality. The evaluation method was as follows. The obtained toners were filled into the developer of an HL-2040 (laser printer by Brother Kogyo K.K., developer TN-350, drum unit DR-350), in accordance with a predetermined method, then the amount of charge (μS/g) on the developing roller was measured.

Using the above laser printer, the presence of fogging on an initial print pattern was assessed visually and printing durability performance in a high-temperature high-humidity environment (32.5° C., 80% humidity) was evaluated. Specifically, a print pattern having a print surface area ratio of 4% was printed one by one, with an interval of 17 seconds between sheets, for a total 2500 sheets, to visually evaluate printing image quality. In the above evaluation, total absence of fogging was denoted by double circle mark (excellent), instances where presence of fogging could not be decided unless under intent gazing were denoted by circle mark (good), slight fogging in part of an A4 sheet was denoted by triangle mark(fair), and ostensible fogging was denoted by cross mark (poor). The paper used for evaluation was XX 4200 paper. A print was outputted, without printing, but undergoing a developing step in the laser printer, to carry out white solid printing. The whiteness of the paper (Y1) was measured using a whiteness meter, and the value of fogging on the paper was taken as the whiteness difference ($\Delta Y = Y1 - Y0$) relative to the whiteness (Y0) of a fresh paper sheet. The measurements were averaged for five sites, namely the four corners and the center of the A4 sheet. The results are summarized in Table 1.

As Table 1 shows, the conductivity of toners 1 to 5 of the examples ranged from 3.3 to 70 μS/cm, while the conductivity of the suspensions (re-suspensions) of toner base particles ranged from 2.4 to 4.5 μS/cm. The toners of Examples 1 to 5 allowed thus obtaining a stable positive charge amount, with no initial fogging, and no observable fogging under a high-temperature high-humidity environment. This is apparent from the fact that there is virtually no change from the initial paper fogging value (0.2 to 0.7, average 0.34) to the high-temperature high-humidity paper fogging value (0.5 to 0.9, average 0.60, increment 0.26). The toners of the examples exhibited thus stable charge characteristics in durability tests such as under a high-temperature high-humidity environment, in addition to under initial conditions.

In toners 6 and 7 of Comparative examples 1 and 2, by contrast, the conductivity of the base particle suspension exceeded 100 to 400 μS/cm, while the conductivity of the toner base particle suspension (re-suspension) was 2.4 to 3.6 μS/cm. Only initial fogging and slight fogging under a high-temperature high-humidity environment were observed in these toners, but some pronounced fogging was observed in high-temperature high-humidity durability, which was indicative of the poor charge characteristics of the toners. This is apparent also in the light of the marked increase from the initial paper fogging value (1.1, 1.9, average 1.45) to the high-temperature high-humidity paper fogging value (2.5, 3.4, average 3.0, increment 1.55). The high-temperature high-humidity paper fogging value in Comparative examples 6 and 7 was about five times that of Examples 1 to 5, while the fogging value increment in Comparative examples 6 to 7 was about six times that of Examples 1 to 5.

Toner 8 of Comparative example 3, which did not undergo washing of the toner base particles, had a base particle suspension conductivity of 10 μS/cm and a toner base particle suspension conductivity of 10 μS/cm. Although no initial fogging was observed in toner 8, the initial paper fogging value thereof was 0.9, and the toner exhibited a marked fogging under a high-temperature high-humidity environment (paper fogging value of 2.8), which was indicative of poor charge characteristics in the toner.

These results indicated that a positive charging toner having excellent charge characteristics can be achieved, and in particular, a marked improvement in high-temperature high-humidity fogging can be attained by controlling the conductivity of the base particle suspension to be not higher than 70 μS/cm, and thereby limiting initial fogging and high-temperature high-humidity fogging. As the pronounced improvement in high-temperature high-humidity fogging makes clear, controlling the conductivity of the base particle suspension allows providing a toner that boasts good positive charge characteristics stably over long periods of time. This finding underscores the adverse effect that adhesion of precipitated additives, which are present in conventional base particle suspensions, exert on positive charge characteristics, this adverse effect being greater than expected under high-temperature high-humidity environments.

The surfactant concentration in the base particle suspensions of toners 1 to 5 ranged from 7 to 220 ppm. It was found that initial fogging (paper fogging value) and high-temperature high-humidity fogging (paper fogging value) tend to increase as the surfactant concentration becomes lower. In toners 6 and 7, by contrast, the amount of surfactant in the base particle suspension was considerable, in excess of 300 ppm. The above indicates that surfactant concentration in the base particle suspension decreases along with conductivity, when conductivity is controlled, and that the surfactant concentration can be reduced to no more than 300 ppm by controlling conductivity.

The results show thus that, although it is difficult to improve charge characteristics by washing the toner base particles, i.e. by washing after fixing of the charge control resin microparticles to the base particles, it is nonetheless possible to effectively improve the charge characteristics of the positive charging toner by controlling the conductivity of the base particle suspension prior to application of the charge control resin microparticles. The results showed that doing so allows effectively improving charge characteristics, in particular, under high-temperature high-humidity environments.

Although as illustrated in Table 1, the conductivities of the base particle suspension exhibit variation within a range from 3.3 to 70 μS/cm, a positive charging toner can be efficiently obtained by adjusting the amount of charge control resin microparticles added relative to the base particles (0.25 to 1.2), as illustrated in Table 1, with the magnitude of conductivity taken into consideration. In the production of the positive charging toners of the examples, thus, the amount of charge control resin microparticles externally added can be adjusted on the basis of the controlled conductivity of the base particle suspension. Therefore, the effective amount of charge control resin microparticles can be easily determined, and the amount of charge control resin microparticles used can be also reduced by referring to the controlled conductivity of the base particle suspension.

These relationships can be represented by the charge control resin microparticle coefficient of Table 1 (solids ratio (%) of the charge control resin microparticles to the base particles, relative to the conductivity (μS/cm) of the base particle suspension). The toner where this coefficient relating to base particle suspension conductivity is lowest is toner 5 (0.014) of Example 5. Therefore, the amount of charge control resin microparticles used in the production of the positive charging toner can be easily optimized by determining the amount of charge control resin microparticles that must be added in such a manner that that the coefficient is not smaller than 0.014.

What is claimed is:

1. A method for producing a positive charging toner comprising a polyester resin as a main component, the method comprising the steps of:

preparing a base particle suspension having a conductivity not higher than 70 μS/cm and comprising base particles that are obtained by mixing and emulsifying an aqueous medium and a resin solution containing the polyester resin;

producing toner base particles by mixing the base particle suspension with a charge control resin microparticle suspension containing charge control resin microparticles and causing the charge control resin microparticles to adhere to the surfaces of the base particles; and washing the toner base particles.

2. The method according to claim 1, wherein the step of preparing the base particle suspension comprises producing the base particles by aggregating resin microparticles obtained through the mixing and emulsifying.

3. The method according to claim 2, wherein the step of preparing the base particle suspension further comprises producing the base particles by aggregating the resin microparticles, and thereafter lowering the conductivity by replacing at least a part of the aqueous medium.

4. The method according to claim 1, wherein the step of preparing the base particle suspension is a step of preparing the base particle suspension containing therein no more than 300 ppm of a surfactant.

5. The method according to claim 1, wherein a charge control resin microparticle coefficient represented by formula (1) is not smaller than 0.014 in the step of producing toner base particles:

charge control resin microparticle coefficient=((charge control resin microparticle amount(mg)/base particle amount(mg)×100))/conductivity of base particle suspension(μS/cm) (1)

wherein the charge control resin microparticle amount is the amount of charge control resin microparticles contained in the total amount of charge control resin microparticle suspension used, and the base particle amount is the amount of base particles contained in the total amount of base particle suspension used.

6. The method according to claim 1, wherein the charge control resin microparticles comprise particles having a styrene-acrylic copolymer as a main component.

7. The method according to claim 1, wherein the charge control resin microparticles comprise a quaternary ammonium group.

8. The method according to claim 1, wherein the washing step is a step of carrying out washing until a re-suspension that is obtained by re-suspending the washed toner base particles in an aqueous medium having a conductivity not higher than 1 μS/cm and contains 10 wt % solids of the washed toner base particles, has a conductivity not higher than 5 μS/cm.

* * * * *